US005213117A

United States Patent [19]

Yamamoto

[11] Patent Number: 5,213,117

[45] Date of Patent: May 25, 1993

[54] PARTS WASHER

[76] Inventor: Soichiro Yamamoto, 2 Allen Manner, Unionville, Ontario, L6C 1B2, Canada

[21] Appl. No.: 930,902

[22] Filed: Aug. 17, 1992

Related U.S. Application Data

[63] Continuation of Ser. No. 726,310, Jul. 5, 1991, abandoned.

[51] Int. Cl.[5] ..... B08B 3/02

[52] U.S. Cl. ..... 134/58 R; 134/58 DL; 134/102.2; 134/199; 134/200

[58] Field of Search ..... 134/58 R, 358 D, 58 DL, 134/95.3, 98.1, 102.2, 111, 170, 171, 198, 199, 200

[56] References Cited

U.S. PATENT DOCUMENTS

| | | | |
|---|---|---|---|
| 2,558,628 | 6/1951 | Redin . | |
| 2,632,719 | 3/1953 | Tankersley | 134/102.2 X |
| 2,745,418 | 5/1956 | Balcom et al. . | |
| 2,797,530 | 7/1957 | Graver . | |
| 2,948,285 | 8/1960 | Poe et al. . | |
| 3,070,104 | 12/1962 | Faust et al. | 134/145 |
| 3,422,826 | 1/1969 | Ballard | 134/107 |
| 3,601,135 | 8/1971 | Marlow et al. . | |
| 3,771,539 | 11/1973 | De Santis | 134/111 |
| 4,025,363 | 5/1977 | De Santis | 134/111 X |
| 4,051,858 | 10/1977 | Mele | 134/111 X |
| 4,676,261 | 6/1987 | Blaul | 134/200 X |
| 4,785,836 | 11/1988 | Yamamoto | 134/170 X |
| 4,793,369 | 12/1988 | Robb et al. | 134/170 |

*Primary Examiner*—Philip R. Coe
*Attorney, Agent, or Firm*—Baker & Daniels

[57] ABSTRACT

An apparatus for cleaning paint guns and related accessories includes a housing defining a washing chamber, a fluid manifold located within the washing chamber having fluid jets attached thereto, a solvent storage tank, an air-flow system and a fluid distribution system for driving the solvent from the storage tank to the manifold for washing the parts mounted on the fluid jets. A timer is provided for control of the washing cycle time and a preset time may be used which is greater than the time required to empty the storage tank thereby providing a drying cycle. In one aspect, the solvent storage tank is provided with a movable barrier dividing the tank into an air chamber and a solvent chamber with the air-flow system coupled to the air chamber so that when pressurized the movable barrier drives the solvent through the fluid distribution system to the manifold. A removable solvent tank is included which is coupled to the solvent chamber by the fluid distribution system. The air-flow system is provided with an air control system which is responsive to the level of the solvent in the solvent storage container and provides for pressurization of the storage container for discharging the solvent, and for sucking solvent from the removable solvent tank to fill the storage container to a predetermined level.

32 Claims, 7 Drawing Sheets

PARTS WASHER

This application is a continuation of U.S. patent application Ser. No. 07/726,310, filed Jul. 5, 1991, now abandoned.

FIELD OF THE INVENTION

The present invention relates to an apparatus and method for cleaning spray paint guns and related accessories.

BACKGROUND OF THE INVENTION

Paint shops in general and particularly those doing high volume work require rapid and efficient cleaning procedures for cleaning paint equipment. Devices such as spray guns must be cleaned immediately after use in order to avoid drying of paint in the inner mechanism of the guns, as this leads to clogging of narrow channels and orifices therein. The chemicals generally employed in paint cleaning are highly volatile and flammable organic solvents which may present a health hazard upon direct exposure to either the liquid itself or the vapours thereof.

Presently available parts washers for cleaning paint spray guns and associated accessories are of several general types. One type utilizes a solvent pump for circulating paint removing solvent between a collection chamber and a washing chamber with the former situated substantially below the latter. There are two drawbacks to this type of arrangement. Firstly, the rate of solvent circulation is fixed by certain inherent properties of the pump including the internal dimensions of the fluid flow path through the pump and the speed of the solvent circulation means, usually a reciprocating piston. Secondly, since the solvent recirculation process involves drawing the solvent from the collection chamber through the pump and discharging it into the washing chamber, the pump intake in communication with the collection chamber is usually provided with a filter. This is necessary in order to prevent the intake of paint chips and other debris into the pump which would lead to clogging and loss of pumping efficiency over time. While the pump intake is usually positioned above the bottom of the collection chamber where the bulk of the paint debris collects, the pumping action of the pump will draw material into the filter thereby clogging the filter and hence slowing down the pumping rate over time. Accordingly there is a need to provide a parts washer with a solvent circulation system with greater pumping speeds and requiring minimal maintenance.

A second type of parts washer uses pressurized air to pressurize a solvent storage tank or holding tank, flowing the solvent under pressure to the washing chamber and using gravity to flow the paint saturated solvent back to the holding tank. Filters are arranged in the solvent return path for filtering out paint chips and other debris. Over time these filters must be removed and cleaned which can be a time consuming procedure. A difficulty with this type of parts washer is that it must be manually operated, and as such may, due to operator miscalculation, be run for too short a period of time resulting in the articles being improperly cleaned.

The build-up of solvent vapours within the washer during the cleaning procedure is circumvented in some cases by flowing compressed air through the working chamber following the solvent washing cycle. This serves to dry the cleaned parts in addition to reducing the build-up of vapours but is accomplished by manually opening an air valve after the washing cycle thereby necessitating the presence of an operator during the cleaning procedure.

SUMMARY OF THE INVENTION

The subject invention provides a parts washer which utilizes pressurized air to flow solvent under pressure from a container having a movable barrier to a washer compartment. The barrier separates the container into two compartments including a solvent storage chamber and an air chamber that is sealingly separated from the solvent storage chamber. An air-flow system, which includes an air inlet, is in flow communication with the air chamber for pressurizing same in order to drive the movable barrier from a first to a second position in order to drive the solvent through a fluid distribution system.

According to one aspect of the invention, there is provided a parts washer apparatus for cleaning spray paint equipment with a solvent comprising an enclosed washing chamber having a chamber lid. A fluid manifold is located within the washing chamber and has a plurality of nozzles for spraying solvent into the washing chamber. A container has a movable barrier located therein which separates the container into two compartments, one compartment defining a solvent storage chamber and the other compartment defining an air chamber that is sealingly separated from the solvent storage chamber. The barrier is movable between a first position corresponding to the solvent chamber having a maximum volume and a second position corresponding to the solvent chamber having a minimum volume. A fluid distribution system interconnecting the solvent chamber with the fluid manifold for delivering the solvent from the storage means to the fluid manifold is provided. There are means for returning used solvent from the washing chamber to the solvent storage chamber. An air-flow system is in flow communication with the air chamber for pressurizing the air chamber thereby driving the movable barrier from the first position to the second position in order to drive the solvent through the fluid distribution system. The air-flow system is provided with an air inlet means. The air-flow system and the fluid distribution system have independent flow lines.

In another aspect of the invention, there is provided a parts washer apparatus for cleaning spray paint equipment comprising a housing having a bottom and enclosing a washing chamber having a lid. A fluid manifold is located within the washing chamber and has a plurality of nozzles and spray jets for spraying fluid into the washing chamber. A removable solvent tank is located below said bottom of the housing. A releasable coupling means connects the removable solvent tank to a solvent outlet provided in the housing for flow of solvent from the washing chamber to said tank. A solvent storage means is also provided. A solvent distribution system is provided having a supply line interconnecting the solvent storage means with the fluid manifold, and a return line interconnecting the solvent tank and the solvent storage means. The supply and return lines have one-way check valves located therein for one-way solvent flow from the solvent storage means to the manifold and from the solvent tank to the solvent storage means. An air-flow system is in communication with the solvent storage means for pressurizing the solvent storage means in order to drive the solvent though the solvent distribution system. The air-flow system is provided with an air inlet.

In yet another aspect of the invention, a parts washer apparatus for cleaning spray paint equipment includes a housing defining a washing chamber having a chamber lid and a bottom opening and provided with a lower solvent collection tray located below the opening. A fluid manifold is located within the washing chamber and has a plurality of nozzles and spray jets for spraying solvent into the washing chamber. A removable solvent tank is located below the bottom of the housing. A releasable coupling means connects the removable solvent tank to the solvent outlet opening for flow of solvent from the washing chamber to said tank. A container is provided which has a movable barrier located therein which separates the container into two compartments, one compartment defining a solvent storage chamber and the other compartment defining an air chamber that is sealingly separated from the solvent storage chamber. The barrier is movable between a first position corresponding to the solvent chamber having a maximum volume and a second position corresponding to the solvent chamber having a minimum volume. A solvent distribution system includes a solvent supply line interconnecting the solvent chamber with the fluid manifold and a solvent return line for delivering the solvent from the solvent tank to the solvent storage chamber. An air-flow system is in flow communication with the air chamber for pressurizing the air chamber thereby driving the movable barrier from the first position to the second position in order to drive the solvent through the solvent supply line system. The air-flow system is provided with an air inlet means and air control means coupled to the air inlet means. The air-flow system and the fluid distribution system have independent flow lines. A time control means is coupled to the air inlet for turning the air flow on and off and hence the fluid flow according to a preset time delay.

According to yet another aspect of the invention there is provided a method of supplying cleaning solvent to a parts washer of the type having a cleaning tank with a sump and a spray manifold for spraying solvent on the parts to be cleaned. The method comprises the steps of providing a container of solvent and a supply line coupling the solvent container to the manifold for the flow of solvent from the container to the manifold. A return line is provided in communication with the sump and the solvent container, the return line having a check valve for one-way fluid flow from the sump to the container. The container is pressurized for a first predetermined time interval to force the solvent through the manifold.

BRIEF DESCRIPTION OF THE DRAWINGS

Preferred and alternative embodiments of the invention will now be described by way of example with reference to the accompanying drawings, in which.

DETAILED DESCRIPTION OF THE PREFERRED EMBODIMENT

Figure 1:
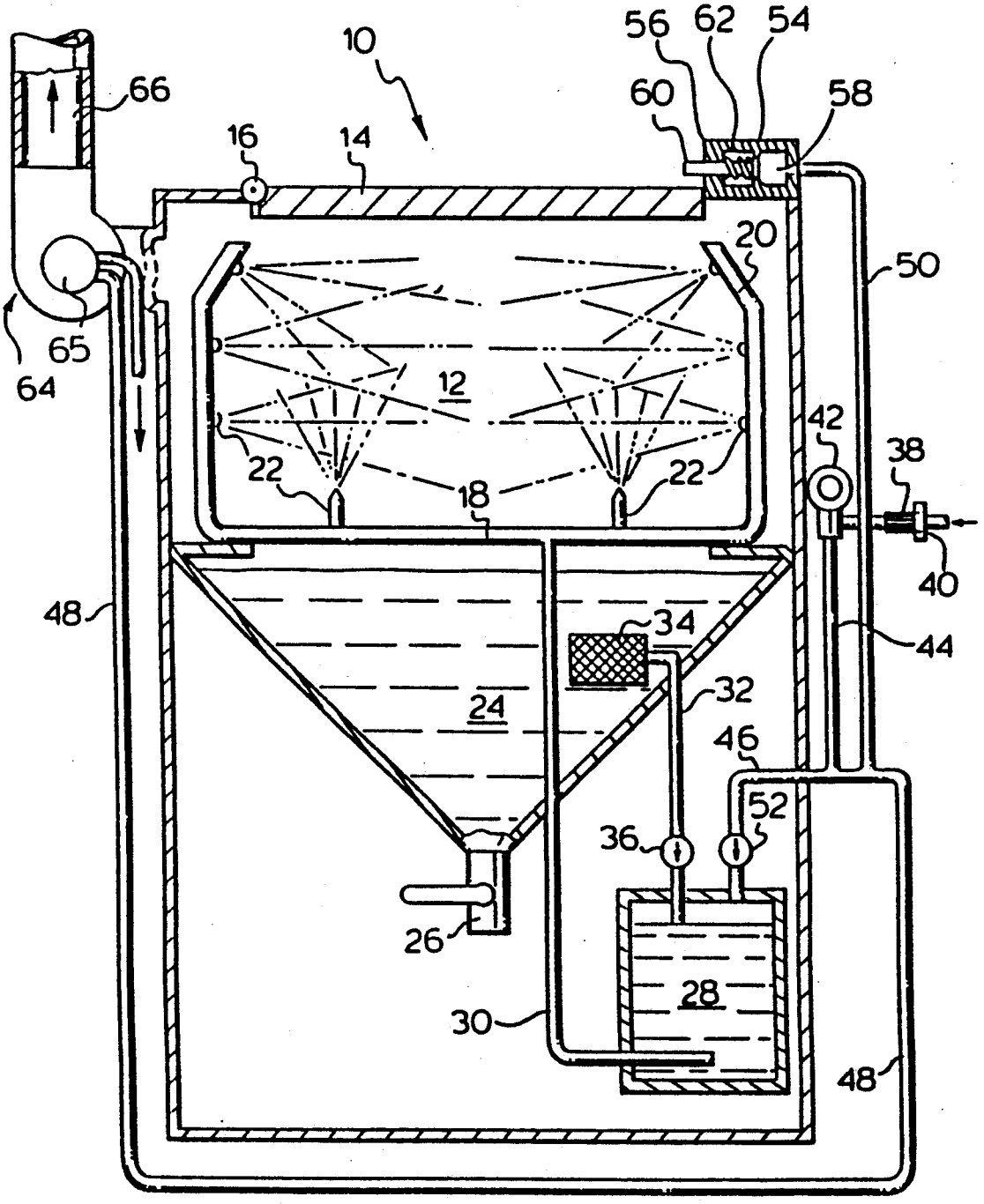
FIG. 1 is a vertical sectional view of a preferred embodiment of a parts washer according to the present invention.

Referring first to FIG. 1, a parts washer 10 embodying the subject invention includes a housing defining a cleaning chamber 12 with a bottom opening and a chamber lid 14 attached by a hinge 16 to the Washer top. Chamber 12 has a spraying manifold 18 located therein comprising a tube 20 provided with a plurality of solvent nozzles or jets 22 attached thereto. Chamber 12 has a lower sump or solvent collection chamber portion 24. Chamber portion 24 is in the shape of an inverted pyramid, the lower apex of which is provided with a solvent drain valve 26.

A solvent storage tank 28 is coupled to manifold 18 by means of a fluid distribution system comprising tube 30 connected between substantially the bottom of tank 28 and manifold 18, and a tube 32 between tank 28 and collection chamber 24. A solvent filter 34 is located on the end of tube 32 situated in chamber 24. Tube 32 is also provided with a weak check valve 36 wherein the arrow indicates the direction of solvent flow through the valve.

An air-flow system is provided which comprises an air inlet 38 connected to a supply line 40 and a pneumatic timer valve 42. Valve 42 is of the mechanical escapement type activated by a pulse of air pressure when the valve is opened. Valve 42 includes an adjuster for adjusting the time interval during which the valve remains open, and a pressure relief port to prevent tank 28 from being overpressurized. Of course, any suitable type of timer valve could be used. The air-flow system includes a tube 44 coupling timer valve 42 to the rest of the air-flow system including branch lines 46, 48 and 50. Line 46 is in flow communication with solvent tank 28 and is provided with a one way strong check valve 52 wherein the arrow indicates the direction of air-flow through the valve.

Chamber 12 is provided with a lid locking mechanism shown generally as 54 and which is of the spring loaded type comprising a tube 56 having a bore 58 therethrough. A piston or plunger 60 is slidably receivable therein or reciprocable in bore 58, and a spring 62 is concentrically mounted around piston 60. Branch line 50 couples lid locking mechanism 54 to the air-flow system. When branch line 50 is pressurized, plunger 60 is extended to prevent lid 14 from being opening, and when branch line 50 is not pressurized, spring 62 retracts plunger 60 so that the lid can be opened.

As an alternative, locking mechanism 54 could be a pressure relief valve whereby the opening of lid 14 causes plunger 60 to retract allowing the air pressure in bore 58 and thus branch line 50 to escape. In this case, check valve 52 would not be used, so that upon the relief of pressure in branch line 50, pressure in tank 28 would also be relieved stopping the flow of solvent from tank 28 to manifold 18 when lid 14 is opened.

Washing chamber 12 is provided with an exhaust means 64 comprising a vent 66 and an air-flow actuated exhaust fan 65. The exhaust fan 65 is coupled to the air-flow system by branch line 48.

In operation, the timer adjuster on pneumatic timer valve 42 is adjusted to give the desired time delay. With the inlet line air pressure set at the appropriate pressure, preferably around 60 psi, timer valve 42 opens thereby admitting pressurized air to line 44 and into branch line 46, through check valve 52 and into tank 28 to pressurize tank 28. Simultaneously, pressurized air flows through branch line 50 which activates chamber lid locking mechanism 54 thereby locking lid 14 in the closed position. Pressurized air flowing through branch line 4 activates exhaust means 64 for venting solvent fumes from chamber 12. As solvent tank 28 is pressurized the presence of strong check valve 36 in tube 32 prevents solvent flowing under pressure from tank 28 to collection chamber 24. Once pressurized, the contents of tank 28 are discharged through tube 30 to manifold 18 and into the interior of washing chamber 12 through spray nozzles 22 onto which the spray paint gun parts and accessories are mounted for cleaning. The solvent discharged into washing chamber 12 flows through the bottom opening in chamber 12 and into collection chamber 24. The solvent returns to tank 28 through filter 34 via tube 32 once the pressure in tank 28 is relieved. Paint chips and other debris sink to the bottom of the collection chamber for later removal by opening valve 26.

Typically, for an air line pressure in the vicinity of 60 psi and a solvent storage tank volume of one gallon it has been found that the time for pressurizing an discharging the solvent tank is approximately 11 seconds. In contrast, using a solvent pump for recirculating solvent between the collection chamber and washing chamber in the same approximate geometry takes approximately 40 seconds to circulate the same volume of solvent. Thus, timer valve 42 would be preset for the minimum time required to adequately clean the spray pant parts which is of the order of 10 seconds. After timer valve 42 closes, the air-flow is terminated which deactivates lid locking mechanism 54. Lid 14 is then opened and the washed parts removed and replaced.

After several washing cycles it may be desirable to replace the paint saturated solvent. To accomplish this, a disposable solvent container is positioned below collection chamber 24, valve 26 is opened and the solvent is drained. When the solvent is drained below the level of intake tube 32 solvent tank 28 can be pressurized to cause its contents to be emptied into collection chamber 24 to complete the draining procedure. After the solvent has been drained from the system lid 14 is opened and fresh solvent is poured into chamber 12 to the appropriate level.

Figure 2:
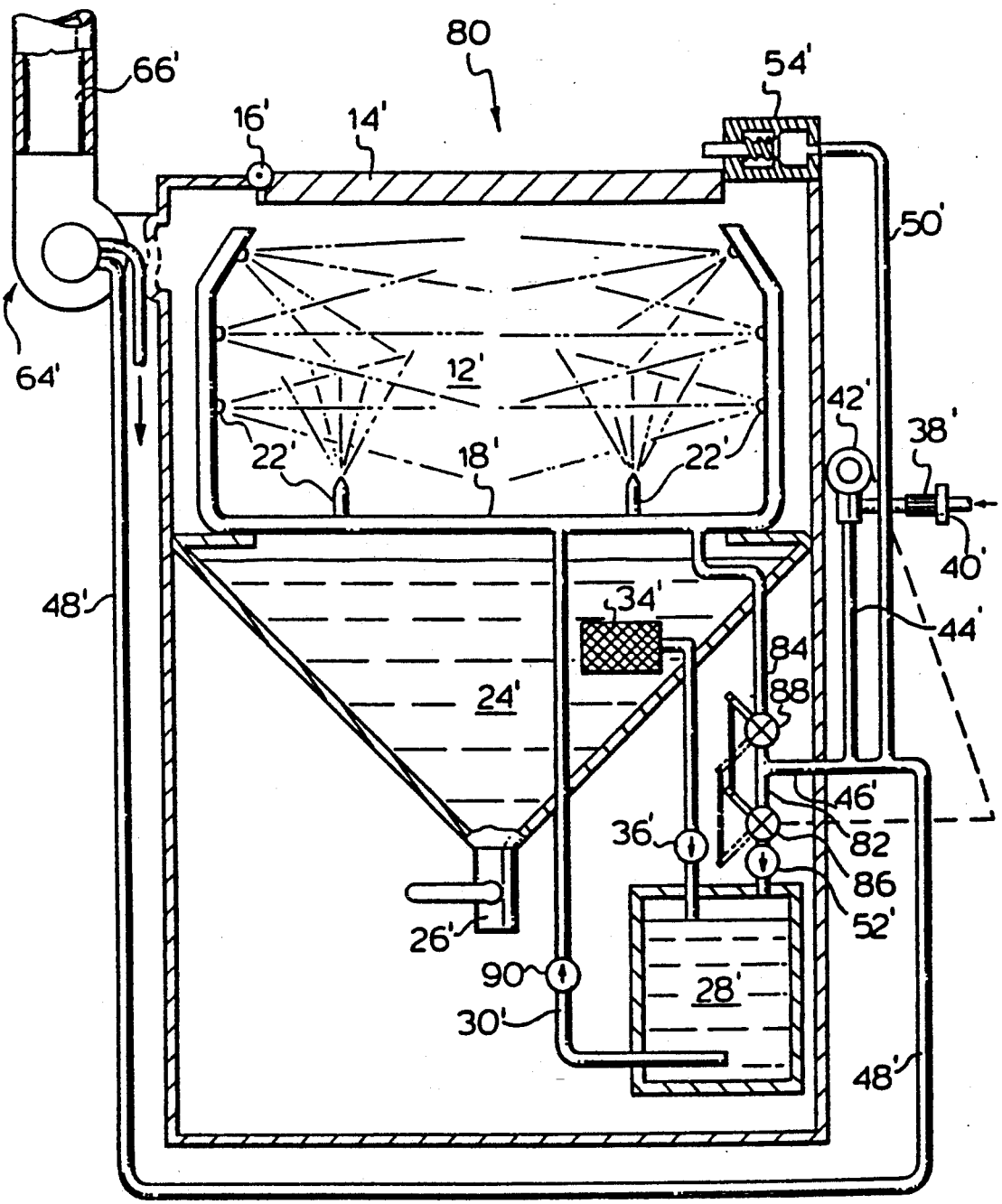
FIG. 2 is a vertical sectional view of an alternative embodiment of a parts washer.

In FIG. 2 another embodiment of the parts washer is shown generally at 80. In FIG. 2, primed reference numerals indicate parts that are similar to those of the embodiment shown in FIG. 1. In washer 80, the air-flow system comprises air line 46' branching into two branch lines 82 and 84. Branch line 82 communicates with solvent tank 28' and branch line 84 communicates with manifold 18'. Branch line 82 is provided with a pneumatic timer valve 86 and branch line 84 is provided with a valve 88 wherein valves 86 and 88 are coupled together in such a way that when timer valve 86 is open, valve 88 is closed and vise-versa. Timer valve 86 is coupled to pneumatic timer valve 42' with the broken line indicating this coupling. Tube 30' is provided with a weak check valve 90 wherein the arrow indicates the direction of solvent flow through valve 90.

In operation parts washer 80 functions in essentially the same way as washer 10 but with the following differences. When timer valve 42' is opened for a first predetermined interval, coupled timer valve 86 is automatically set to the open position thereby closing valve 88. Pressurized air flows from inlet 38' to solvent tank 28' thereby pressurizing it and discharging solvent through tube 30' to manifold 18'. Timer valve 86 closes automatically after a second predetermined time interval after the full contents of tank 28' have been discharged, (typically between 10–12 seconds with an air line pressure of 60 psi) thereby opening valve 88. Pressurized air then flows through branch line 84 to manifold 18' and through jets 22' to ultimately impinge on the previously washed spray paint gun parts in an air drying cycle. This air drying cycle terminates when the preset time on timer valve 42' expires. Exhaust means 64' acts to exhaust chamber 12' for removing solvent vapours as well as to prevent pressurizing the solvent in collection chamber 24' during the air drying cycle. By using fluid manifold 18' for both solvent washing followed by air drying, all residual solvent will be purged from manifold 18' and nozzles 22' thereby further reducing venting of solvent vapours when chamber 12' is opened. The presence of check valve 90 in line 30' prevents tank 28' from being pressurized during the air drying cycle, but this check valve could be eliminated, if desired.

In choosing the time delays for timer valves 42' and 86, there are several possible choices. In one limit, they may both have the same time delay in which case timer 86 merely tracks timer 42' and the washer behaves in essentially the same manner as washer 10 illustrated in FIG. 1 having no air drying cycle. Preferably, timer valve 82 has a preset time delay shorter than that of valve 42' and corresponding to the time required to discharge the full contents of tank 28', approximately 10–12 seconds. Thus, after a washing cycle valve 86 closes thereby opening valve 88 whereupon the washed parts are subjected to a drying cycle. The length of the drying cycle depends on the preset time on timer valve 42'. Therefore, a variable air drying cycle is obtained.

Figure 3:
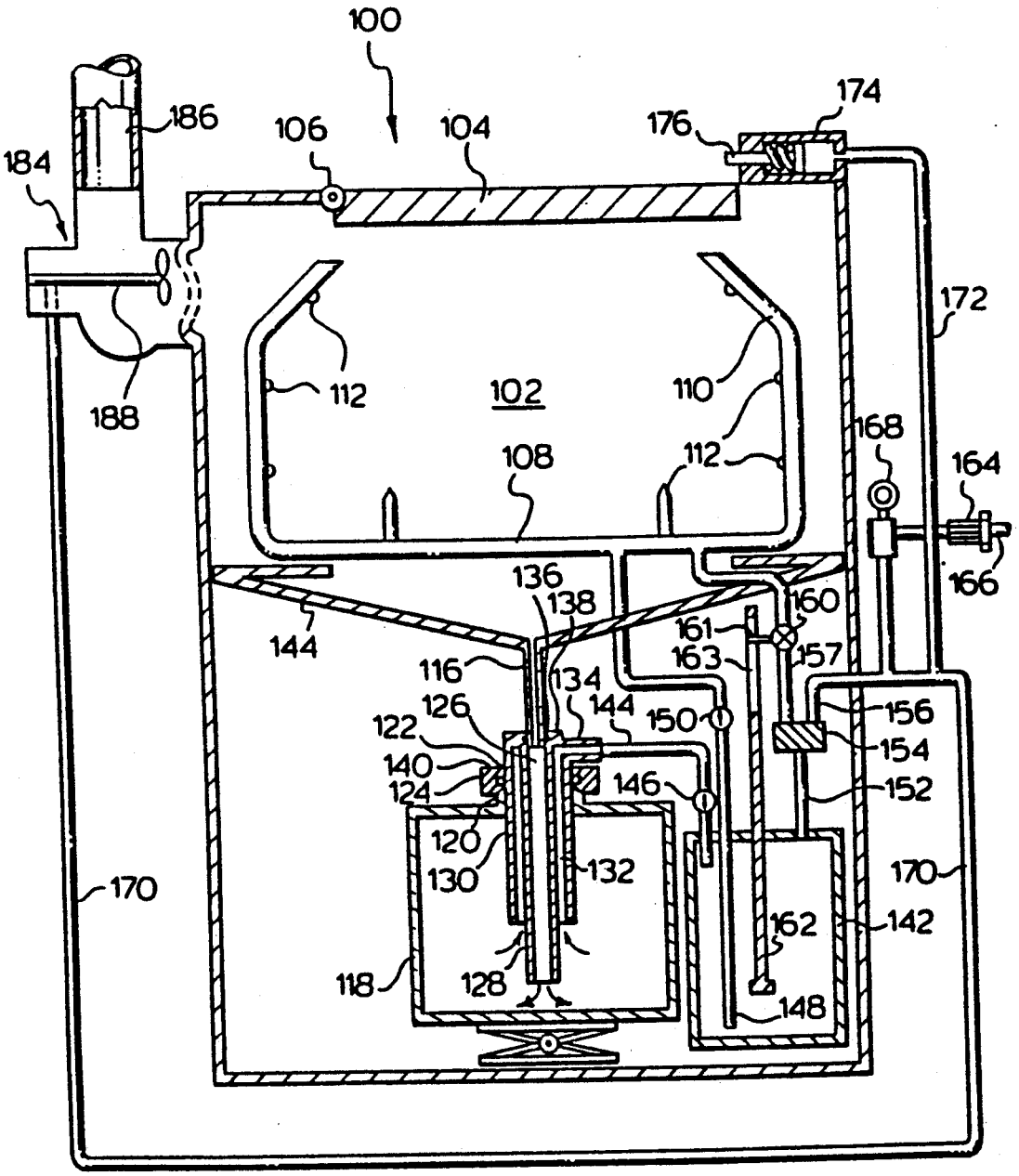
FIG. 3 is a vertical sectional view of yet another embodiment of a parts washer.

FIG. 3 illustrates yet another embodiment of the parts washer of the present invention. A parts washer shown generally at 100 includes a washing chamber 102 and a lower solvent collection or drain tray 114. A chamber lid 104 is attached by a hinge 106 to the housing. Chamber 102 includes a spraying manifold 108 having a tube 110 provided with a plurality of solvent jets 112. Drain tray 114 is situated below chamber 102 for collecting and downwardly directing the solvent. The lower open apex of tray 114 terminates in a tube 116.

A removable solvent storage tank 118 is located below solvent tray 114 and is provided with a threaded neck 120. Tank 118 is in flow communication with tray 114 by tube 116 and a releasable coupling 122 which forms part of the fluid distribution system. Releasable coupling 122 has a threaded flange 124 and a central opening 126 and is threaded onto neck 120. Releasable coupling 122 comprises an inner tube 128 defining central opening 126 and which is concentrically disposed within a shorter outer tube 130 having an inner diameter greater than the outer diameter of tube 128. An annular passageway 132 formed between tubes 128 and 130 communicates with a side wall outlet port 134. Tube 116 is in flow communication with tube 128 and an inner annular O-ring 136 seated within an O-ring groove 138 telescopically seals tube 116 in tube 128. An annular gasket or O-ring 10 is disposed between neck 120 and flange 124.

A second solvent storage means or accumulator tank 142 is provided which is connected to tank 118 by a tube 144 which is a solvent return line and also forms part of the fluid distribution system. Tube 144 is connected between side wall port 134 and tank 142 for flow communication therebetween. Tube 144 is provided with a check valve 146 wherein the arrow indicates the direction of fluid flow therethrough. Check valve 146 prevents both air and solvent from back-flowing from tank 142 to tank 118. The fluid distribution system further comprises a solvent supply line in the form of tube 148 extending from substantially the bottom of tank 142 to solvent manifold 108 and includes a strong check valve 150 wherein the arrow indicates the flow direction therethrough.

Figure 4:
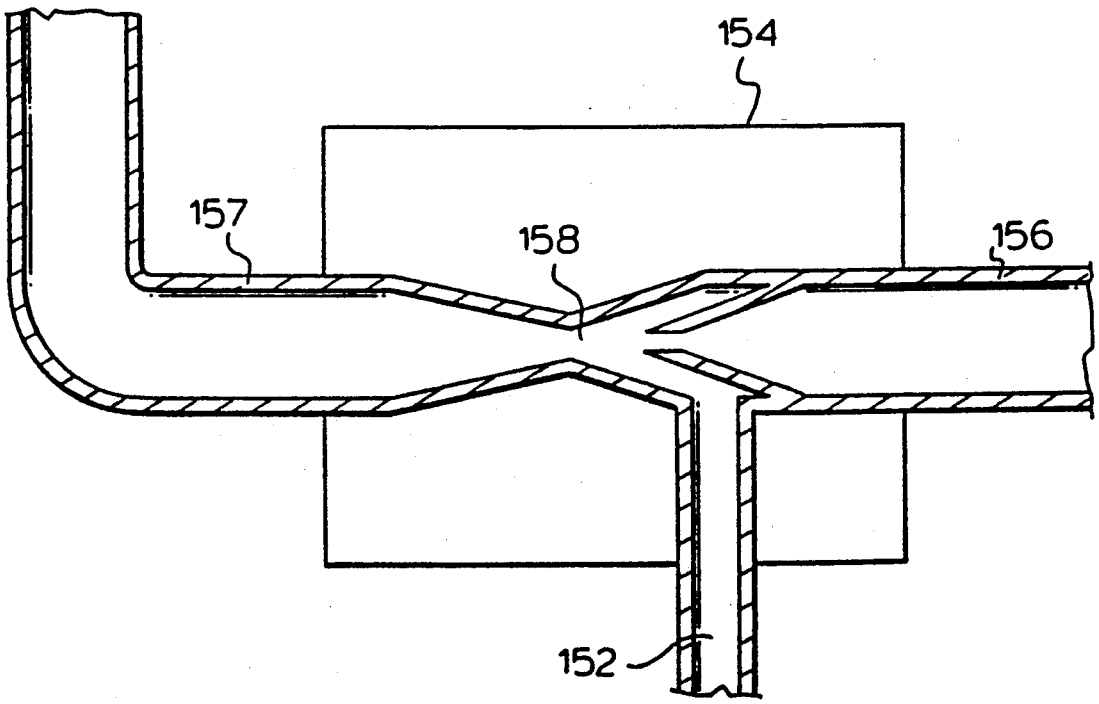
FIG. 4 is a sectional side view of an ejector utilized in the embodiment illustrated in FIG. 3.

An air-flow system comprises a tube 152 attached at one end to the top of solvent tank 142 in flow communication therewith and an ejector 154 (see FIG. 4) attached to the other end of tube 152. Referring to FIGS. 3 and 4, ejector 154 includes an inlet tube 156, an outlet tube 157 and a constricted portion 158. Tube 152 communicates with constricted portion 158 and the venturi effect caused by air flow from inlet tube 156 to outlet tube 157 causes a suction in tube 152. A shut-off valve 160 is located in tube 157, and has an actuator arm 161 extending therefrom.

Storage tank 142 is provided with a float type solvent level sensor 162 which has a vertical rod with a slot 163 formed therein into which actuator arm 161 of valve 160 is slidingly located. When the solvent level in tank 142 reaches a certain height or is full, the bottom of slot 163 hits ar 161 of valve 160 causing the valve to close. When the solvent level in tank 142 falls to the bottom, the top of slot 163 hits arm 161 of valve 160 causing the valve to open. The end of tube 157 is connected to manifold 108, so that when valve 160 is open, air passing through ejector 154 goes to washing chamber 102.

Tube 156 is connected to a pneumatic timer valve 168 which in turn is coupled to an air inlet 164 which is fed by air line 166. Timer valve 168 is in flow communication with branch lines 156, 170 and 172.

Chamber 102 is provided with a lid locking mechanism shown generally as 174 including a spring biased piston 176 which is similar to locking mechanisms 54 and 54' shown in FIGS. 1 and 2.

Washing chamber 102 is provided with an exhaust means 184 including a vent 186 and an air-flow actuated fan 188. Exhaust fan 188 is coupled to branch line 170 thereby providing flow communication between timer valve 168 and fan 188.

In operation, the spray paint guns and associated accessories are secured to their various stations (not shown) to be cleaned by nozzles 112. Removable solvent storage container 118 is located below tray 114 and releasable coupling 122 is connected thereto.

Solvent tank 142 is empty initially and must be filled prior to cleaning since it is the source of the solvent fed to manifold 108. With the pressurized air source activated, timer valve 168 is turned on thereby admitting pressurized air into tube 156. With valve 160 initially open, the increased velocity of air through ejector 154 results in a reduced pressure or suction in suction line 152. This negative pressure acts to create a partial vacuum in tank 142 which causes the solvent in storage tank 118 to be sucked through annular passageway 132 and through outlet port 134 to tank: 142 via tube 144.

As solvent is pumped into tank 142, the reduced pressure therein will lead to some evaporation of the solvent which will be drawn into tube 157. Since tube 157 terminates in manifold 108, these solvent vapours are removed by exhaust fan 184. The fluid level in tank 14 continues to rise until level sensor 162 has risen far enough to engage valve 160 and switch it to the closed position. When valve 160 closes, the pressure builds up within throat 158 which acts to pressurize tank 142 through line 152. Since valve 146 is a one way check valve, there is no back streaming of solvent or air back to container 118 as tank 142 is pressurized. In addition, since check valve 150 is a strong check valve, it does not open the passageway to manifold 108 until a preset pressure is built up within tank 142 in order to ensure a high solvent discharge rate through jets 112 is achieved. With the build-up of sufficient pressure in chamber 142, fluid is forced up tube 148 through check valve 150 to manifold 108 where it is forced out through jets 112 to perform its cleaning function. When timer valve 168 is initially activated, the air flow through tube 172 drives piston 176 forward thereby activating locking mechanism 174. Simultaneously, fan 188 is activated by the air flow through branch line 172. When tank 142 is emptied, timer valve 168 closes and valve 160 opens reducing the pressure in tank 142 to atmospheric pressure. Check valve 146 opens and the paint saturated solvent above solvent collection tray 114 returns to storage tank 118 via tube 116 and releasable coupling 126.

If the preset time interval set on timer valve 168 for air-flow through the system exceeds the time required to empty tank 142, then upon the full contents of tank 142 being discharged, pressurized air will be forced through tube 157 to manifold 108 and cut jets 112 to dry the cleaned parts. The length of time cf this drying cycle is determined simply by the preset time on timer valve 168. If however it is desired to repeat the washing cycle, then the preset time should correspond to roughly the amount of time (or less) required to empty tank 142 for a given volume and air line pressure.

When the solvent becomes saturated with paint, tank 118 is decoupled from the rest of the parts washer, sealed and disposed of as required.

It will be appreciated that by employing the pressurizing circulation system described herein, an automatic air drying cycle results by choosing the appropriate time delay for the timer valve 168. Also, readily interchangeable solvent storage tank 118 allows for convenient and safe handling and disposal of waste solvent since tank 118 can be readily removed, sealed and replaced once it has been filled with paint saturated solvent. This arrangement avoids the possibility of exposure to solvent by spillage associated with the operations of draining the solvent or by pouring fresh solvent into washing chamber 102

By being able to directly control the pressurized air line pressure and the tube sizing, high volumes of solvent can be passed through the system at relatively high rates in periods of time significantly shorter than can be achieved using reasonably sized solvent pumps. Specifically, for a one gallon solvent tank, with an air input pressurized at 60 psi, the pumping-pressurizing cycle takes approximately 15–20 seconds to fill and discharge solvent from the tank while a solvent pump would require a time of the order of 40 seconds in order to pass the same volume.

It will also be understood that by interlocking the washer lid and the exhaust fan with the pressurized air line, the venting of solvent vapours from the washing chamber during the washing cycle is minimized. Indeed it should be appreciated that the exhaust fan and the locking mechanism could be interlocked with a gas sensor means instead of the pressurized air system and thereby predicating the opening of the washer on the measured air quality.

Figure 5:
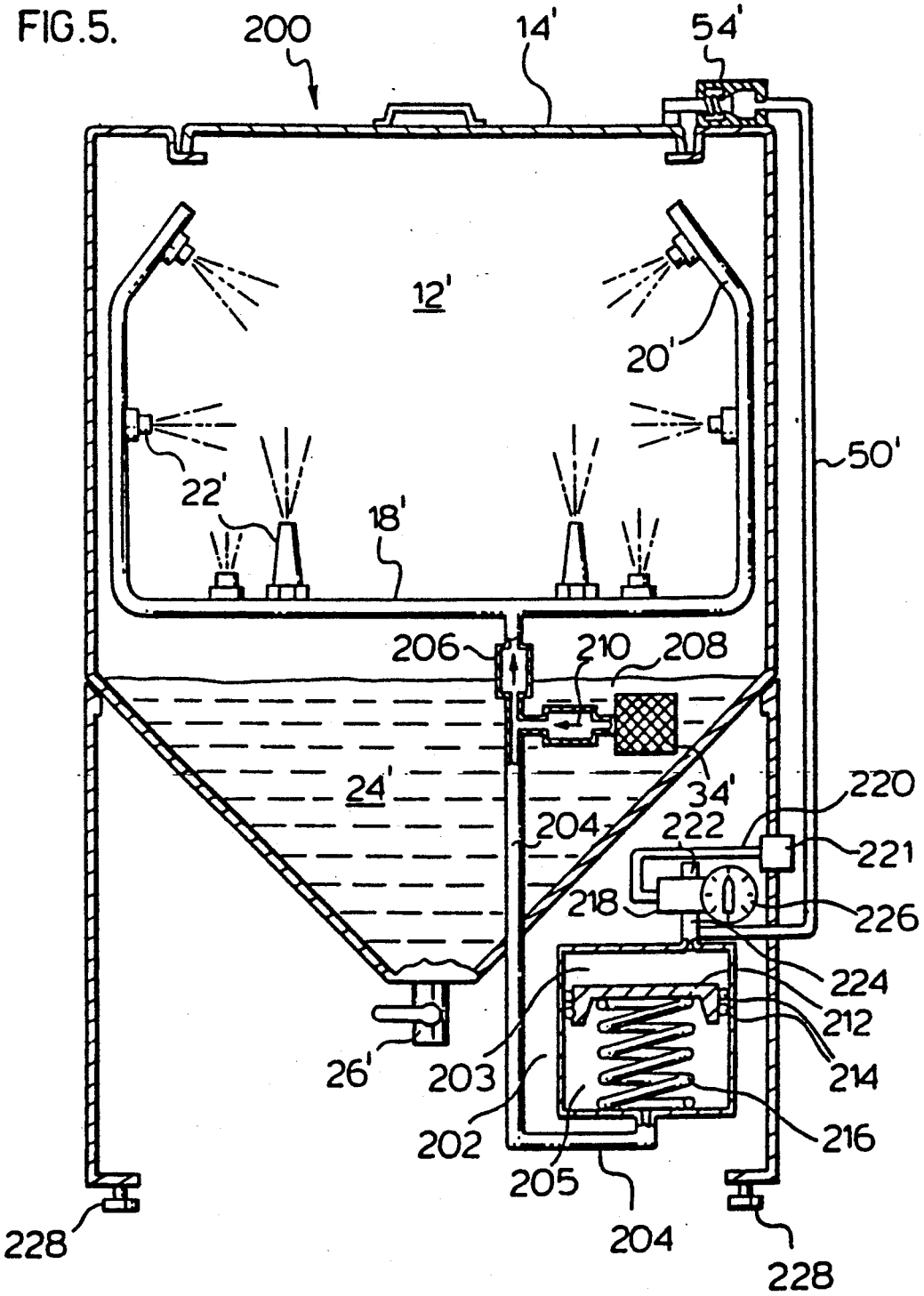
FIG. 5 illustrates a vertical sectional view of another preferred embodiment of a parts washer utilizing a dual compartment accumulator tank.

Referring now to FIG. 5, another preferred embodiment of the parts washer of the subject invention shown at 200 utilizes a two compartment accumulator tank 202. Tank 202 is coupled to manifold 18' by means of a fluid distribution system comprising a tube 204 connected substantially between the bottom of tank 202 and manifold 18'. Tube 204 includes a strong check valve 206 wherein the arrow indicates the direction of solvent flow therethrough. Coupled to tube 204 and located substantially within collection chamber 24' is a solvent return line 208 which is provided with solvent filter 34' and a strong check valve 210 interposed between tube 204 and filter 34'. The arrow indicates the direction of solvent flow through valve 210.

Accumulator tank 202 includes a piston 212 and seal or gasket members 214. Tank 202 is provided with a spring 216 extending between piston 212 and the bottom of tank 202. The presence of piston 212 and seals 214 acts to divide tank 202 into an upper air chamber 203 and a separate lower solvent chamber 205.

An air-flow system which is independent of the fluid distribution system is provided which comprises a 3-way air valve 218 which has an air inlet line 220 connected in turn to an air inlet 221, an air exhaust line 222 and an air line 224 which is in flow communication with air chamber 203. Air valve 218 may be either timer controlled, using a timer 226 as shown in FIG. 5, or a delayed action manual 3-way air valve could be used. Alternatively, air valve 218 may be mechanically coupled or linked to piston 212 so that when piston 212 reaches the end of the discharge cycle, air valve 218 is automatically closed. Such a coupling may be achieved using an arrangement similar to that illustrated in FIG. 3 comprising actuator arm 161 (now coupled to piston 212) with slot 163 and valve switch 161.

Parts washer 200 is provided with adjustable legs 226 for facilitating level adjustment of washer 200.

Figure 6:
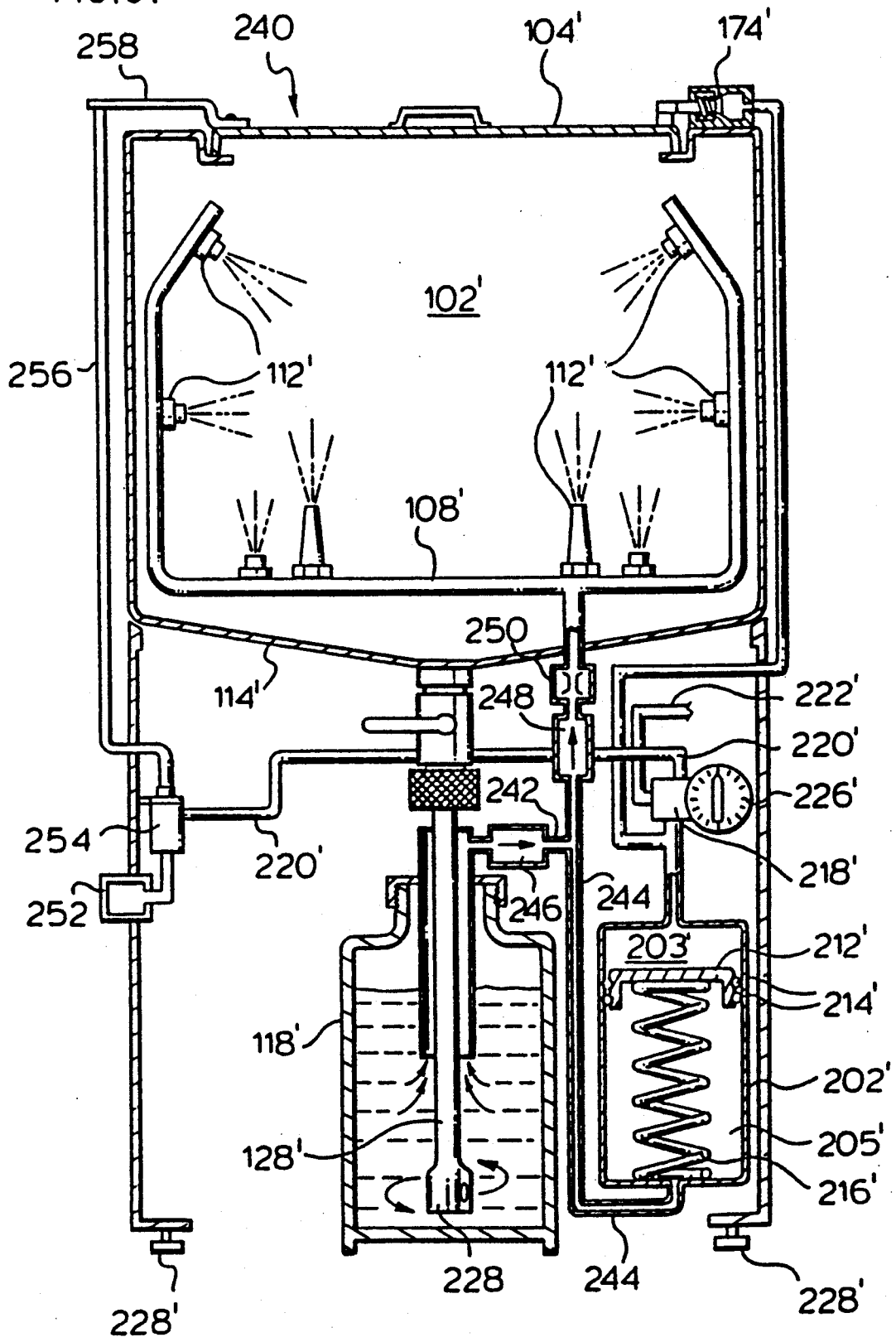
FIG. 6 illustrates a vertical sectional view of still another embodiment of a parts washer.

Referring now to FIG. 6, yet another embodiment of a parts washer is shown at 240 and includes a drain pipe 128' located in solvent tank 118' and is provided with a ported drain outlet 228 (see inset) which causes the solvent flow to undergo a whirling action inside container 118'. This acts to push solid paint particles and chips outwards thereby preventing recirculation of same through the fluid flow system. Accumulator tank 202' is connected to storage tank 118' by a fluid distribution system comprising tubes 242 and 244. Tube 242 is provided with a strong check valve 246 which permits solvent flow from storage tank 118' to accumulator tank 202' only. Tube 244 includes a strong check valve 248 located in that portion of tube 244 between the junction of tubes 242 and 244 and manifold 108'. Tube 244 is also provided with a flow restricter 250 located in that portion of tube 244 between valve 248 and manifold 108'. Flow restricter 250 may be a needle valve or other adjustable valve. The purpose of restricter 250 is to adjust the flow rate of solvent into manifold 108' in order to prevent too rapid or too slow discharge of solvent from accumulator 202'.

This embodiment of the parts washer is provided with an air flow system comprising an inlet 252 coupled to a mechanically actuated air inlet valve 254 which in turn is coupled to 3-way air valve 218' by an air line 220'. A spring loaded push rod 25 is provided which extends between air inlet valve 254 and substantially the top of washing chamber 102'. Lid 104' has a push lever 258 which is adapted to depress push rod 256 when lid 104' is placed on chamber 102 thereby actuating inlet valve 254 to admit pressurized air to 3-way air valve 218'. Lifting lid 104' causes spring loaded push rod 256 to return to its original position thereby closing air inlet valve 254.

Accumulator tank 202' is provided with a spring biased piston 212' and associated gasket or seal 214' thereby dividing tank 202' into upper air chamber 203' and lower solvent chamber 205'.

Figure 7:
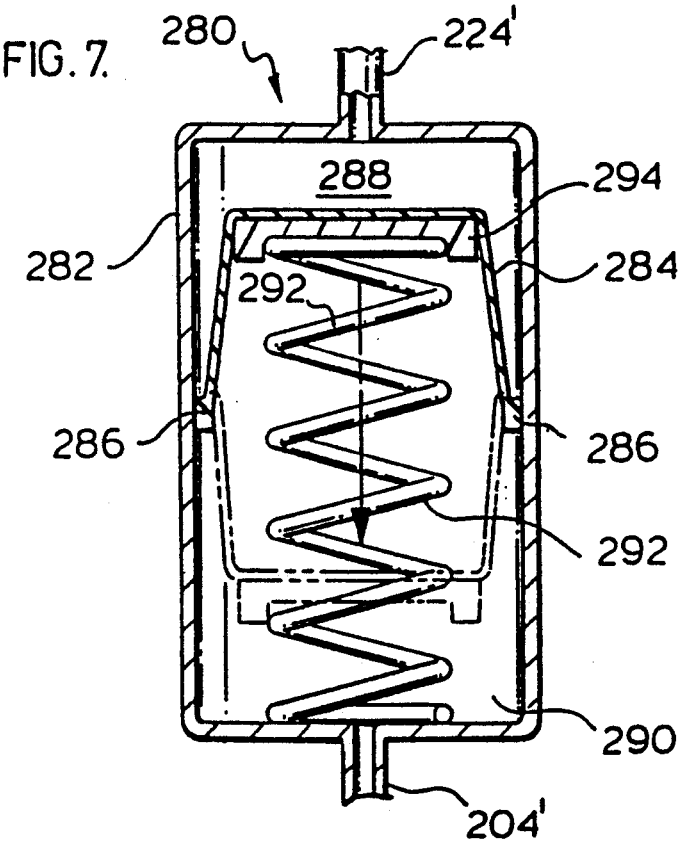
FIG. 7 shows a sectional view of an alternative embodiment of a dual compartment solvent accumulator using a reversing diaphragm.
Figure 8:
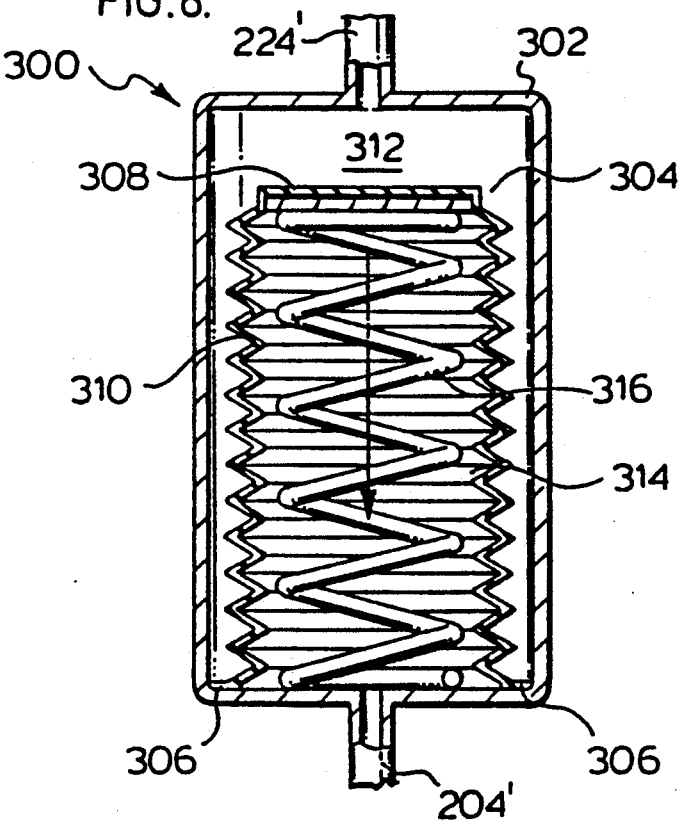
FIG. 8 illustrates a sectional view of still another dual compartment solvent accumulator utilizing a spring biased bellows.

FIGS. 7 and 8 illustrate alternative embodiments of the dual compartment accumulator tanks. FIG. 7 shows a dual compartment tank 280 which includes a container 282 provided with a reversing diaphragm 284 circumferentially secured around the interior of container 282 at 286 thereby dividing container 282 into an upper air chamber 288 and a lower solvent chamber 290. Reversing diaphragm 284 is biased by a spring 292 extending between the bottom of container 282 and a piston 294 mounted thereon. Diaphragm 284 may be fabricated from a metal foil of appropriate gauge and flexibility or alternatively may be constructed using a chemically resistant plastic or vinyl.

FIG. 8 illustrates a dual compartment accumulator tank at 300 provided with a container 302 having a bellows 304 mounted therein and forming a seal therewith around the bottom portion cf container 302 at 306. Bellows 304 has a planar top portion 308 and a flexible side portion 310. Bellows 304 divides container 302 into an air chamber 312 and a solvent chamber 314. A spring 316 extending between the bottom of chamber 314 to top portion 308 biases bellows 304 upwards when chamber 302 is not pressurized The material of construction of the piston, reversing diaphragm or bellows may be a chemically resistent plastic such as polypropylene, polyethylene or nylon to mention just a few. Metal may also be used if desired.

An alternative method of forming a two compartment container is to use a flexible membrane or balloon (not shown) mounted within container 302 in such a way that as air enters via inlet 224', the membrane expands towards solvent outlet 204' thereby forcing the cleaning solvent out of container 302.

Referring again to FIG. 6, the operation of the preferred embodiments of parts washers utilizing the dual compartment accumulator tanks will now be discussed. When the paint spray gun components are mounted in washing chamber 102', lid 104' is closed which depresses push rod 256 thereby opening air inlet valve 254 and admitting pressurized air up to 3-way air valve 218'. When timer 226' is actuated, compressed air is admitted into air chamber 03' which is then pressurized. Once sufficient pressure has built up in air chamber 203' to overcome the force of return spring 216', piston 212' is then pushed down against the force of the return spring which causes the flow of solvent through tube 244, check valve 248 and flow restricter 250 to manifold 18' where it is sprayed into washing chamber 202' via the various solvent jets. When the preset washing cycle time of timer 226' expires, 3-way air valve 218' closes and the compressed air remaining in air chamber 203' is vented out through exhaust line 222'. Return spring 216' then pushes return piston 212' back to its original position thereby creating a partial vacuum in solvent chamber 205 which acts to draw solvent from tank 118' into chamber 205'. Thus accumulator tank 202' is recharged for the next washing cycle. The combination of lid actuated air inlet valve 254 and lid locking mechanism prevent lid 104' from being opened during the washing cycle in addition to preventing accumulator tank 202' being pressurized before the lid is placed on the washing chamber.

While the present invention has been described and illustrated with respect to the preferred and alternative embodiments, it will be appreciated that numerous variations of these embodiments may be made without departing from the scope of the invention, which is defined in the appended claims.

I claim:

1. A parts washer apparatus for cleaning spray paint equipment with a solvent, comprising:

(a) an enclosed washing chamber having a chamber lid;

(b) fluid manifold means located within the washing chamber provided with a plurality of nozzles for spraying said solvent into the washing chamber;

(c) a container having means defining a movable barrier located therein, the barrier separating the container into two compartments, one compartment defining a solvent storage chamber and the other compartment defining an air chamber that is sealingly separated from said solvent storage chamber, the barrier movable between a first position corresponding to the solvent chamber having a maximum volume and a second position corresponding to the solvent chamber having a minimum volume;

(d) fluid distribution system interconnecting the solvent storage chamber with the fluid manifold means for delivering the solvent from the storage chamber to the fluid manifold means;

(e) means for returning said solvent from said washing chamber to said solvent storage chamber; and (f) an air-flow system in flow communication with the air chamber for pressurizing the air chamber in order to drive the movable barrier from the first to the second position for driving solvent through the fluid distribution system, said air-flow system being provided with an air inlet means and the fluid distribution system and the air-flow system having independent flow lines.

2. A parts washer according to claim 1 including means for stopping the air flow into solvent storage chamber after a predetermined period of time in order to provide a predetermined washing cycle period.

3. A parts washer according to claim 2 wherein the means for stopping the air flow includes a time control means coupled to the air inlet means for turning the air-flow on and off and hence the fluid-flow according to a preset time delay.

4. A parts washer according to claim 2 wherein the means for stopping the air flow includes a pneumatic timer valve.

5. A parts washer according to claim 1 wherein the chamber lid is provided with a lid locking means and the chamber includes an exhaust means coupled to the washing chamber for exhausting solvent vapors, and wherein the air-flow system is operably connected with the exhaust means and the washer lid locking means for correlatively controlling the exhaust means and the like locking means.

6. A parts washer according to claim 1 wherein the movable barrier includes a piston and seals, including resilient biasing means for biasing the piston to the first position.

7. A parts washer according to claim 1 wherein the movable barrier includes a flexible bellow, including resilient biasing means for biasing the bellows to the first position.

8. A parts washer according to claim 1 wherein the movable barrier includes a reversing diaphragm, the diaphragm sealably secured to the interior wall of the container including resilient biasing means for biasing the reversing diaphragm to the first position.

9. A parts washer according to claim 1 wherein the movable barrier includes a flexible membrane sealably secured to the interior wall of the container.

10. A parts washer apparatus for cleaning spray paint equipment with a solvent, comprising:

(a) a housing having a bottom and enclosing a washing chamber having a lid:

(b) a fluid manifold located within the washing chamber provided with a plurality of nozzles for spraying fluid into the washing chamber;

(c) a removable solvent tank located below said bottom of the housing;

(d) a releasable coupling means connecting the removable solvent tank to a solvent outlet provided in said housing for flow of solvent from the washing chamber to the solvent tank;

(e) solvent storage means;

(f) a solvent distribution system having a supply line interconnecting said solvent storage means with the fluid manifold, and a return line interconnecting said solvent tank and solvent storage means, the supply and return lines having one-way check valves located therein for one-way solvent flow from the solvent storage means to the manifold and from the solvent tank to the solvent storage means; and (g) an air-flow system in communication with the solvent storage means for pressurizing said solvent storage means in order to drive the solvent through the solvent distribution system, said air-flow system being provided with an air inlet.

11. A parts washer according to claim 10 including means for stopping the air flow after a preset time delay in order to provide a preset washing cycle period, said stopping means comprising a time control means coupled to the air inlet for turning the air-flow on and off and hence solvent flow according to a preset time delay.

12. A parts washer apparatus according to claim 11 wherein the preset time delay is longer than the time for filling and discharging solvent from the solvent storage means, so that air is driven through the supply line after the fluid in the storage means is discharged.

13. A parts washer according to claim 11 wherein the chamber is provided with an exhaust means for exhausting solvent vapors and lid locking means and the air-flow system is operably connected with said exhaust means and the lid locking means for correlatively controlling the exhaust means and the lid locking means by the time control means.

14. A parts washer according to claim 10 including means for stopping the air flow after a preset time delay in order to provide a preset washing cycle period, said stopping means comprising a pneumatic timer valve.

15. A parts washer according to claim 10 wherein said air-flow system has air control means connected to said air inlet and responsive to the level of solvent in said solvent storage means so as to permit the solvent storage means to be filled with solvent and then to apply air pressure to the solvent storage means, and the air control means includes an ejector having a solvent suction line in flow communication with said solvent storage means and a fluid outlet, the air control means further including a shut-off valve for closing an outlet of the ejector causing air pressure to flow through said suction line to pressurize the solvent storage means in order to discharge the solvent therein through the supply line.

16. A parts washer according to claim 15 wherein said air control means includes a solvent level sensor responsive to the level of solvent in the solvent storage means and operably coupled to the shut-off valve for opening and closing the ejector outlet at predetermined solvent levels.

17. A parts washer according to claim 10 wherein said bottom of the housing is a solvent collection tray and said solvent outlet is provided in said tray.

18. A parts washer according to claim 10 wherein said air-flow system includes air control means connected to said air inlet and responsive the level of solvent in said solvent storage means so as to permit the solvent storage means to be filled with solvent and then to apply air pressure to the solvent storage means.

19. A parts washer according to claim 18 including means for stopping the air flow after a preset time delay in order to provide a preset washing cycle period.

20. A parts washer apparatus for cleaning spray paint equipment with a solvent, comprising:

(a) a housing enclosing a washing chamber and having a bottom and a solvent outlet opening in a lower portion of the housing, the chamber having a chamber lid;

(b) a fluid manifold located within the washing chamber provided with a plurality of nozzles for spraying solvent into the washing chamber;

(c) a removable solvent tank located below said bottom of the housing;

(d) a releasable coupling means connecting the removable solvent tank to said solvent outlet opening for flow of solvent from the washing chamber to the solvent tank;

(e) a container having means defining a movable barrier located therein, the barrier separating the container into two compartments, one compartment defining a solvent storage chamber and the other compartment defining an air chamber that is sealingly separated from said solvent storage chamber, the barrier movable between a first position corresponding to the solvent chamber having a maximum volume and a second position corresponding to the solvent chamber having a minimum volume;

(f) a solvent distribution system including a solvent supply line interconnecting the solvent chamber with the fluid manifold, and including a solvent return line for delivering the solvent from the removable solvent tank to the solvent storage chamber; and (g) an air-flow system in flow communication with the air chamber for pressurizing the air chamber in order to drive the movable barrier from the first to the second position for driving solvent through the solvent supply line, wherein the air-flow system is provided with an air inlet means and air control means coupled to the air inlet means, and wherein the solvent distribution system and the air-flow system have independent flow lines.

21. A parts washer according to claim 20 including means for stopping the air flow into the air chamber after a predetermined period of time in order to provide a predetermined washing cycle period, said stopping means comprising a time control means coupled to the air-flow system for turning the air-flow on and off and hence the solvent flow according to a preset time delay.

22. A parts washer according to claim 20 including means for stopping the air flow into the air chamber after a predetermined period of time in order to provide a predetermined washing cycle period, said stopping means comprising a pneumatic timer valve.

23. A parts washer according to claim 20 wherein the air control means is operably coupled to the chamber lid so that pressurized air is admitted into the air-flow system only when the lid is in the closed position.

24. A parts washer according to claim 20 including lid locking means mounted in said housing and exhaust means connected to said housing for removing solvent vapors from said chamber.

25. A parts washer according to claim 24 wherein the lid locking means and the exhaust means are operably coupled to the air-flow system and, when the pressurized air is admitted to the air chamber, the lid locking means is activated and, when the air flow is stopped, said lid locking means is deactivated.

26. A parts washer according to claim 20 wherein the movable barrier includes a piston and seals and said container has resilient biasing means for biasing the piston towards the first position.

27. A parts washer according to claim 26 wherein the piston is fabricated of a chemically resistent material from the class of plastics containing polyethylene, polypropylene and nylon.

28. A parts washer according to claim 20 wherein the movable barrier includes a flexible bellows and resilient biasing means for biasing the bellows towards the first position.

29. A parts washer according to claim 20 wherein the movable barrier includes a reversing diaphragm, the diaphragm sealably secured to the interior wall of the container, and resilient biasing means for biasing the reversing diaphragm towards the first position.

30. A parts washer according to claim 20 wherein the movable barrier includes a flexible membrane sealably secured to the interior wall of the container.

31. A parts washer according to claim 20 further comprising a flow constrictor located in the solvent supply line for constricting the flow of solvent therethrough.

32. A parts washer according to claim 20 wherein the solvent distribution system includes a plurality of check valves for providing one-way fluid flow paths therethrough.

* * * * *